US006045440A

United States Patent [19]

Johnson et al.

[11] Patent Number: 6,045,440

[45] Date of Patent: Apr. 4, 2000

[54] POLYCRYSTALLINE DIAMOND COMPACT PDC CUTTER WITH IMPROVED CUTTING CAPABILITY

[75] Inventors: David Mark Johnson, Westerville; Gary Martin Flood, Canal Winchester; Henry Samuel Marek, Worthington, all of Ohio

[73] Assignee: General Electric Company, Pittsfield, Mass.

[21] Appl. No.: 08/975,429

[22] Filed: Nov. 20, 1997

[51] Int. Cl.[7] ..... B23F 21/03; B23F 21/23; B24B 33/00

[52] U.S. Cl. ..... 451/540; 407/118; 175/432; 408/145

[58] Field of Search ..... 407/118, 119; 408/145; 175/422, 426, 434, 432, 329, 330; 451/540, 548; 76/108 A; 125/40, 42, 43

[56] References Cited

U.S. PATENT DOCUMENTS

| | | | |
|---|---|---|---|
| 3,141,746 | 7/1964 | DeLai . | |
| 3,609,818 | 10/1971 | Wentorf, Jr. . | |
| 3,745,623 | 7/1973 | Wentorf, Jr. et al. . | |
| 3,850,591 | 11/1974 | Wentorf, Jr. . | |
| 4,333,540 | 6/1982 | Daniels et al. | 175/430 |
| 4,394,170 | 7/1983 | Sawaoka et al. . | |
| 4,403,015 | 9/1983 | Nakai et al. . | |
| 4,784,023 | 11/1988 | Dennis . | |
| 4,794,326 | 12/1988 | Friedl . | |
| 4,872,520 | 10/1989 | Nelson . | |
| 4,928,777 | 5/1990 | Shirley-Fisher . | |
| 4,954,139 | 9/1990 | Cerutti . | |
| 4,972,637 | 11/1990 | Dyer . | |
| 4,984,642 | 1/1991 | Renard et al. . | |
| 5,007,207 | 4/1991 | Phaal . | |
| 5,028,177 | 7/1991 | Meskin et al. | 175/430 |
| 5,115,873 | 5/1992 | Pastusek | 175/430 |
| 5,172,777 | 12/1992 | Siracki et al. | 175/430 |
| 5,238,074 | 8/1993 | Tibbitts et al. | 175/428 |
| 5,341,890 | 8/1994 | Cawthorne et al. . | |
| 5,484,330 | 1/1996 | Flood et al. . | |
| 5,486,137 | 1/1996 | Flood et al. . | |
| 5,494,477 | 2/1996 | Flood et al. . | |
| 5,709,279 | 1/1998 | Dennis | 175/430 |
| 5,752,573 | 5/1998 | Scott et al. | 175/430 |

FOREIGN PATENT DOCUMENTS

| | | |
|---|---|---|
| 0 133 386 A2 | 2/1985 | European Pat. Off. . |
| 0 336 697 A2 | 10/1989 | European Pat. Off. . |
| 0 542 237 A1 | 5/1993 | European Pat. Off. . |
| 0 841 463 A2 | 5/1998 | European Pat. Off. . |

*Primary Examiner*—Derris Holt Banks

[57] ABSTRACT

The present invention relates to supported polycrystalline diamond compact cutters (PDC cutters) made under high temperature, high pressure (HT/HP) processing conditions, and more particularly to supported PDC cutters having non-planar cutting surfaces. More specifically, the present invention is for an oriented PDC cutter wherein chips and debris are funneled away from the cutting edge by a raised top surface of the polycrystalline diamond layer (PCD layer). The redirection of the debris is achieved by the creation of high and low regions on the PCD layer, of which there can be a variety of different surface geometry's. Thus, an object of the present invention is to provide a PDC cutter with improved performance through channeling debris away from its cutting edge.

9 Claims, 4 Drawing Sheets

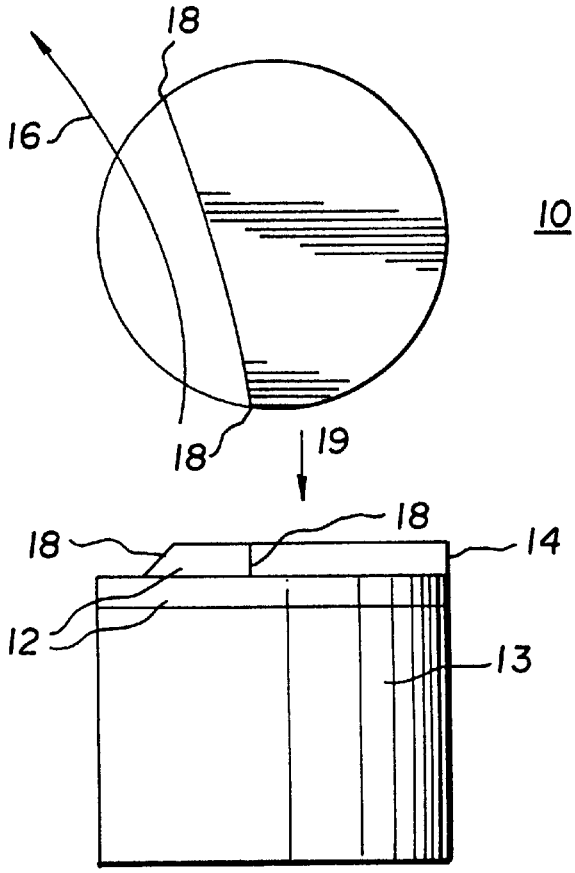
FIG. 3-2
FIG. 3-1
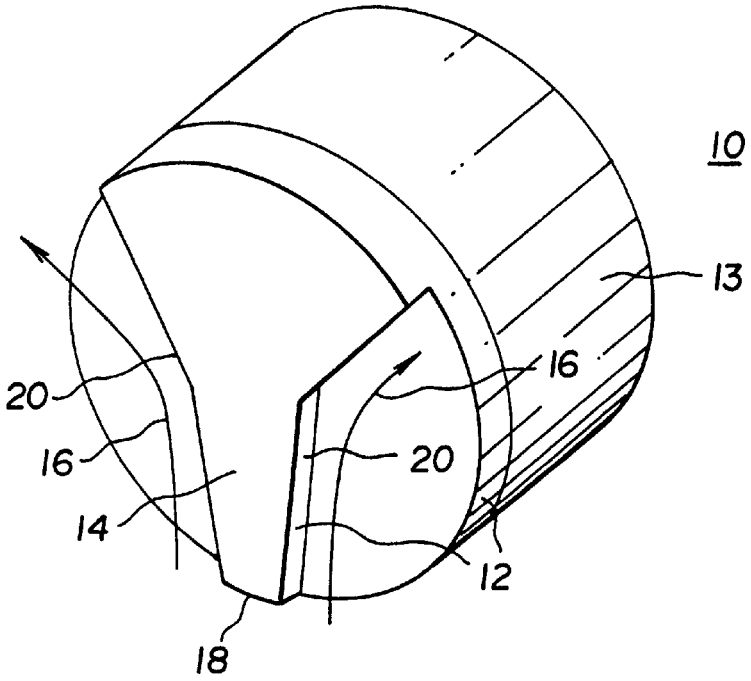
FIG. 5

POLYCRYSTALLINE DIAMOND COMPACT PDC CUTTER WITH IMPROVED CUTTING CAPABILITY

FIELD OF THE INVENTION

The present invention relates to a polycrystalline diamond compact (PDC) cutting element wherein a diamond abrasive layer is bonded to a tungsten carbide (WC) substrate. More specifically, the invention relates to a PDC cutter having a top surface geometry comprising a raised portion of polycrystalline diamond (PCD) which directs material away from the cutting edge and into desired zones and thus providing improved cutting efficiency.

BACKGROUND OF THE INVENTION

Abrasive compacts are used extensively in cutting, milling, grinding, drilling and other abrasive operations. The abrasive compacts typically consist of polycrystalline diamond or cubic boron nitride (CBN) particles bonded into a coherent hard conglomerate. The abrasive particle content of abrasive compacts is high and there is an extensive amount of direct particle-to-particle bonding. Abrasive compacts are made under high temperature and pressure conditions at which the abrasive particle, be it diamond or cubic boron nitride, is crystallographically stable.

Abrasive compacts tend to be brittle and, in use, they are frequently supported by being bonded to a cemented carbide substrate. Such supported abrasive compacts are known in the art as composite abrasive compacts. The composite abrasive compact may be used as such in the working surface of an abrasive tool. Alternatively, particularly in drilling and mining operations, it has been found advantageous to bond the composite abrasive compact to an elongated cemented carbide pin to produce what is known as the stud cutter. The stud cutter is then mounted in the working surface of a drill bit or a mining pick.

Fabrication of the composite is typically achieved by placing a cemented carbide substrate into the container of a press. A mixture of diamond grains or diamond grains and catalyst binder is placed atop the substrate and compressed under high temperature, high pressure (HT/HP) conditions. In so doing, metal binder migrates from the substrate and "sweeps" through the diamond grains to promote a sintering of the diamond grains. As a result, the diamond grains become bonded to each other to form a diamond layer, and that diamond layer is bonded to the substrate along a conventionally planar interface. Metal binder remains disposed in the diamond layer within pores defined between the diamond grains. Methods for making diamond compacts and composite compacts are more fully described in U.S. Pat. Nos. 3,141,746; 3,745,623; 3,609,818; 3,850,591; 4,394,170; 4,403,015; 4,794,326; and 4,954,139, the disclosures of which are expressly incorporated herein by reference.

A composite formed in the above-described manner may be subject to a number of shortcomings. For example, the coefficients of thermal expansion and elastic constants of cemented carbide and diamond are close but not exactly the same. Thus, during heating or cooling of the polycrystalline diamond compact (PDC), thermally induced stresses occur at the interface between the diamond layer and the cemented carbide substrate, the magnitude of these stresses being dependent on the disparity in thermal expansion coefficients and elastic constants.

Another potential shortcoming which should be considered relates to the creation of internal stresses within the diamond layer which can result in the fracturing of that layer. Such stresses also result from the presence of the cemented carbide substrate and are distributed according to the size, geometry and physical properties of the cemented carbide substrate and the polycrystalline diamond layer.

European Patent Application No. 0133 386 suggests PDC in which the polycrystalline diamond body is completely free of metal binders and is to be mounted directly on a metal support. However, the mounting of a diamond body directly on metal presents significant problems relating to the inability of the metal to provide sufficient support for the diamond body. The European Patent Application further suggests the use of spaced ribs on the bottom surface of the diamond layer which are to be embedded in the metal support.

According to the European Application, the irregularities can be formed in the diamond body after the diamond body has been formed, e.g., by laser or electronic discharge treatment, or during the formation of the diamond body in a press, e.g., by the use of a mold having irregularities. As regards the latter, it is further suggested that a suitable mold could be formed of cemented carbide; in such a case, however, metal binder would migrate from the mold and into the diamond body, contrary to the stated goal of providing a metal free diamond layer. The reference proposes to mitigate this problem by immersing the thus-formed diamond/carbide composite in an acid bath which would dissolve the carbide mold and leach all metal binder from the diamond body. There would thus result a diamond body containing no metal binder and which would be mounted directly on a metal support. Notwithstanding any advantages which may result from such a structure, significant disadvantages still remain, as explained below.

In sum, the European Patent Application proposes to eliminate the problems associated with the presence of a cemented carbide substrate and the presence of metal binder in the diamond layer by completely eliminating the cemented carbide substrate and the metal binder. However, even though the absence of metal binder renders the diamond layer more thermally stable, it also renders the diamond layer less impact resistant. That is, the diamond layer is more likely to be chipped by hard impacts, a characteristic which presents serious problems during the drilling of hard substances such as rock.

It will also be appreciated that the direct mounting of a diamond body on a metal support will not, in itself, alleviate the previously noted problem involving the creation of stresses at the interface between the diamond and metal, which problem results from the very large disparity in the coefficients of thermal expansion between diamond and metal. For example, the thermal expansion coefficient of diamond is about $45\times10^{-7}$ cm/cm/°C. as compared to a coefficient of $150–200\times10^{-7}$ cm/cm/°C. for steel. Thus, very substantial thermally induced stresses will occur at the interface. In addition, once the portions of the diamond which do not carry the ribs begin to wear sufficiently to expose the metal therebehind, that metal will wear rapidly, due to its relative ductility and lower abrasion/erosion resistance, and undermine the integrity of the bond between the diamond and the metal support.

Recently, various PDC structures have been proposed in which the diamond/carbide interface contains a number of ridges, grooves or other indentations aimed at reducing the susceptibility of the diamond/carbide interface to mechanical and thermal stresses. In U.S. Pat. No. 4,784,023, a PDC includes an interface having a number of alternating grooves and ridges, the top and bottom of which are substantially parallel with the compact surface and the sides of which are substantially perpendicular to the compact surface.

U.S. Pat. No. 4,972,637 ('637 patent) provides a PDC having an interface containing discrete, spaced recesses extending into the cemented carbide layer, the recesses containing abrasive material (e.g., diamond) and being arranged in a series of rows, each recess being staggered relative to its nearest neighbor in an adjacent row. It is asserted in the '637 patent that as wear reaches the diamond/carbide interface, the recesses, filled with diamond, wear less rapidly than the cemented carbide and act, in effect, as cutting ridges or projections. When the PDC is mounted on a stud cutter, as shown in FIG. 5 of the '637 patent, the wear plane 38 exposes carbide regions 42 which wear much more rapidly than the diamond material in the recesses 18. As a consequence, depressions develop in these regions between the diamond filled recesses. The '637 patent asserts that these depressed regions, which expose additional edges of diamond material, enhance the cutting action of the PDC.

U.S. Pat. No. 5,007,207 ('207 patent) presents an alternative PDC structure having a number of recesses in the carbide layer, each filled with diamond, which make up a spiral or concentric circular pattern, looking down at the disc-shaped compact. Thus, the '207 patent structure differs from the '637 structure in that, rather than employing a large number of discrete recesses, the '207 patent uses one or a few elongated recesses which make up a spiral or concentric circular pattern. FIG. 5 in the '207 patent shows the wear plane which develops when the PDC is mounted and used on a stud cutter. As with the '637 patent, the wear process creates depressions in the carbide material between the diamond-filled recesses. Like the '207 patent, the '637 patent also asserts that these depressions which develop during the wear process enhance cutting action. In addition to enhancing cutting action, non-planar interfaces have also been presented in U.S. Pat. Nos. 5,484,330; 5,494,477; and 5,486,137 which reduce the susceptibility to cutter failure by having favorable residual stresses in critical areas during cutting.

Whereas the aforementioned patents assert a desirable cutting action in the rock and also favorable residual stresses during cutting, it is also highly desirable to minimize the chip and debris build up in the front of the cutter. To achieve this, the outer surface of the abrasive layer can be changed from a pure planar surface to one which has a geometry which will direct chips and debris away from the face of the cutter.

SUMMARY OF THE INVENTION

The present invention discloses an oriented PCD cutter in which the chips and debris are funneled away from the cutting edge by the top surface of the PCD. The redirection of the debris is achieved by high and low regions on the PCD tool. The interface between the PCD and the WC substrate may be either planar or non-planar since the interface is not related to this invention.

Other objects, features, and characteristics of the present invention, as well as the methods of operation and functions of the related elements of the structure, will become more apparent upon consideration of the following detailed description with reference to the accompanying drawings, all of which form a part of this specification.

BRIEF DESCRIPTION OF THE DRAWINGS

FIG. 3 shows an embodiment of the present invention comprising a semicircular-shaped raised PCD region providing two possible cutting edges in one cutter, said raised PCD region serving to deflect debris away from the cutting edge.

FIG. 5 shows a perspective view of the embodiment of the present invention shown in FIG. 4 comprising a Y-shaped raised PCD region.

DETAILED DESCRIPTION OF THE PREFERRED EMBODIMENTS

Polycrystalline diamond compact cutters (PDC cutters) consist of an abrasive layer comprising a polycrystalline diamond layer (PCD layer) bonded to a carbide substrate. The bond between the PCD layer and the carbide support is formed at high temperature, high pressure (HT/HP) conditions. Subsequent reduction of the pressure and temperature to ambient conditions results in internal stresses in both the PCD layer and carbide support due to differences in their thermal expansion coefficients and the compressibility properties of the bonded layers. The differential thermal expansion and differential compressibility have opposite effects of stress development as the temperature and pressure are reduced; the differential thermal expansion tending to cause compressive stresses in the PCD layer and tensile stresses in the carbide support on temperature reduction, whereas the differential compressibility tends to cause tensile stresses in the PCD layer and compressive stresses in the carbide support.

Finite element analysis (FEA) of stress development and strain gage measurements confirm that the differential thermal expansion effect dominates resulting in generally compressive residual stresses (Note: there are localized zones of tensile stresses present) in the PCD layer.

The present invention discloses an improved abrasive tool or cutter which provides for the removal or redirection of chips and debris from the front of the cutter resulting in more efficient cutting. Because kerfing is sometimes used to upset rock at a cutting edge, the present invention breaks a chip that has already formed. Aspects of the bit designs are targeted at preventing chip build up.

The object of this invention is to provide a polycrystalline cutter with improved cutting capability and efficiency through the removal and/or redirection of chips and debris from in front of the cutter.

Figures 1, 2:
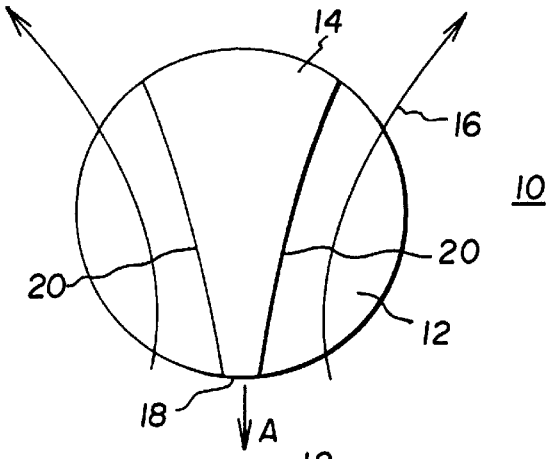
FIG. 1 shows an embodiment of the present invention comprising a raised PCD center region in the cutter, said raised PCD region serving to deflect debris away from the cutting edge.
FIG. 2 shows an embodiment of the present invention comprising a triangular-shaped raised PCD region with three possible cutting edges in one cutter, said raised PCD region serving to deflect debris away from the cutting edge.
Figure 1:
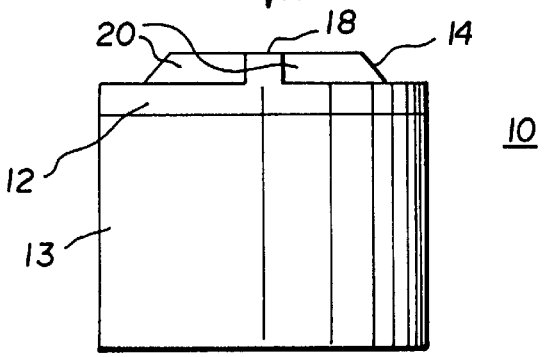

FIG. 1 shows a first embodiment of a PDC cutter 10 of the present invention comprising PCD diamond layer 12 bonded to carbide substrate 13. This embodiment consists of a raised surface 14 in PDC cutter 10. As depicted in FIG. 1, debris 16, such as chips from the cut material, is deflected to the sides of the cutter 10 and away from front of cutter 10 and cutting edge 18 as cutter 10 is moved in direction of motion 19. In this embodiment, debris 16 is deflected by at least two edges 20 which may have straight, convex or concave shapes, but, in another embodiment (see FIG. 3), there may only be one cutting edge 18.

Figure 1A:
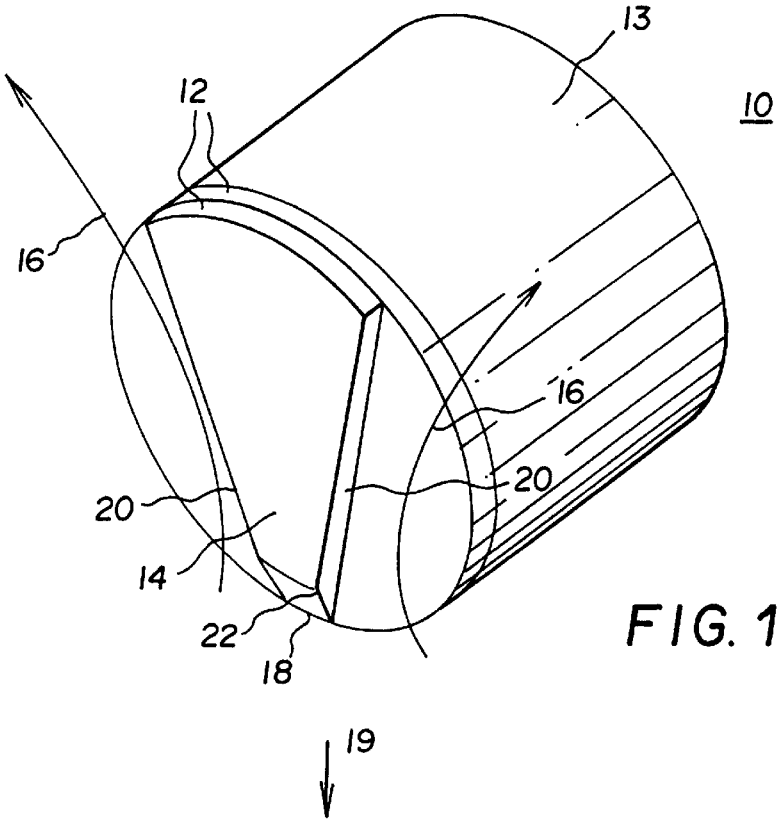
FIG. 1A shows a perspective view of the embodiment of the present invention shown in FIG. 1.

Raised surface 14 and edges 20 of the present invention comprises polycrystalline diamond and acts as a wedge to force debris 16 to the sides, away from the direct path of cutting edge 18. As shown in FIG. 1, raised surface 14 widens and thickens as one moves radially inward, away from cutting edge 18, hence the narrowest point of raised surface 14 is at the front of cutter 10 and cutting edge 18. Additionally, raised surface 14 may fail (i.e., crack, breakout chip, etc.) without causing catastrophic failure of cutter 10. Also as shown in FIG. 1A, cutting edge 18 may also comprise a sloped entry 22 to raised surface 14 for increased cutting action.

Figure 2:
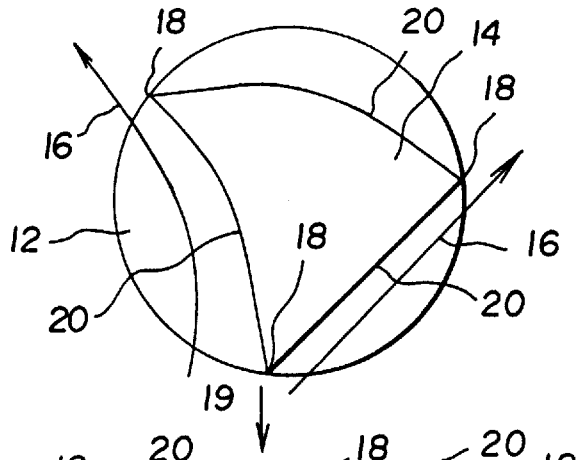
Figures 1, 2:
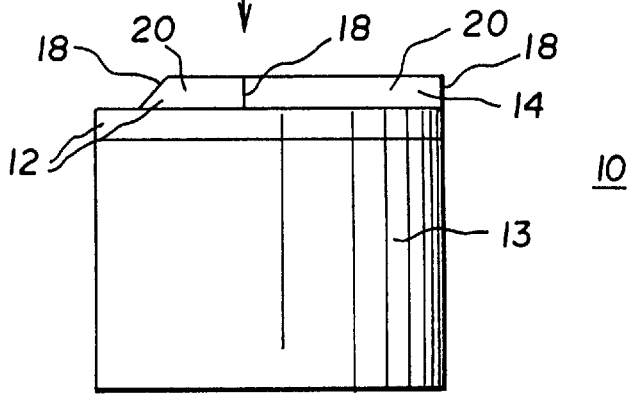
Figure 2A:
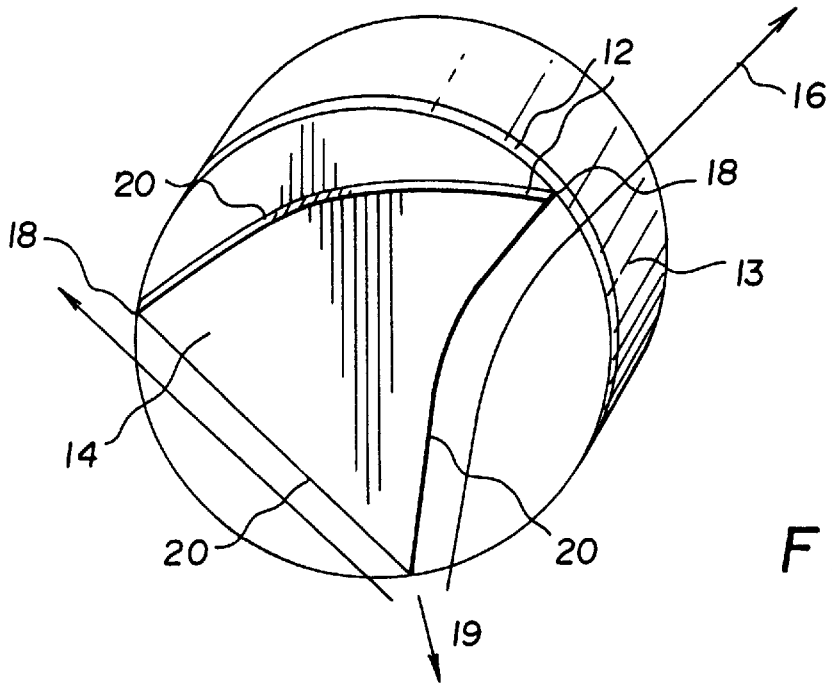
FIG. 2A shows a perspective view of the embodiment of the present invention shown in FIG. 2.

An alternate embodiment of the present invention is shown in FIGS. 2 and 2A. This embodiment also comprises raised surface 14 in the front of PDC cutter 10 where debris 16, such as chips from the material being cut, is deflected to the sides of cutter 10 and away from cutting edge 18. However, as depicted in FIGS. 2 and 2A, in this embodiment, cutter 10 may have three cutting edges all in one cutter, thereby increasing the life of cutter 10 by reorienting it after one edge is worn away.

Similar to the embodiment in FIG. 1, raised surface 14 is made of PCD layer 12 and acts as a wedge to force debris 16 to the sides and out of the direct path of cutting edge 18. As shown in FIGS. 2 and 2A, raised surface 14 also widens and thickens as one moves radially inward, away from cutting edge 18. Additionally, raised surface 14 may fail (i.e., crack, breakout, chip etc.) without significantly affecting the performance of cutter 10. Optionally, cutting edge 18 may also comprise a sloped entry to raised surface 14 for increased cutting action.

FIG. 3 shows yet another embodiment of the present invention. This embodiment consists of a raised surface 14 in PDC cutter 10 comprising only one deflecting edge. As depicted in FIG. 3, debris 16, such as chips from the material being cut, are deflected away from cutting edge 18 while PDC cutter 10 is in use.

Similar to the embodiments in FIGS. 1 and 2, raised surface 14 in FIG. 3 comprises polycrystalline diamond and acts as a wedge to force material to one side, away from the direct path of cutting edge 18. The deflecting edge of raised surface 14 may be straight, convex or concave in shape, so long as raised surface 14 widens, and, optionally, thickens as one moves radial-ly inward, away from cutting edge 18. Additionally, as with all the embodiments of the present invention, raised surface 14 may fail (i.e., crack, breakout, chip, etc.) without significantly affecting the PDC cutter's performance. Moreover, cutting edge 18 may also have a sloped entry to raised surface 14 to enhance the cutting action of cutter 10.

Figure 4C:
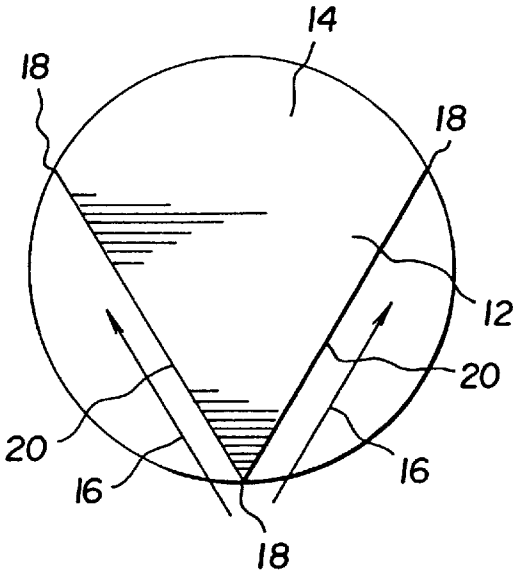
FIG. 4 shows top plan views of three embodiments of the present invention comprising a Y-shaped, U-shaped and V-shaped raised PCD region.
Figure 4B:
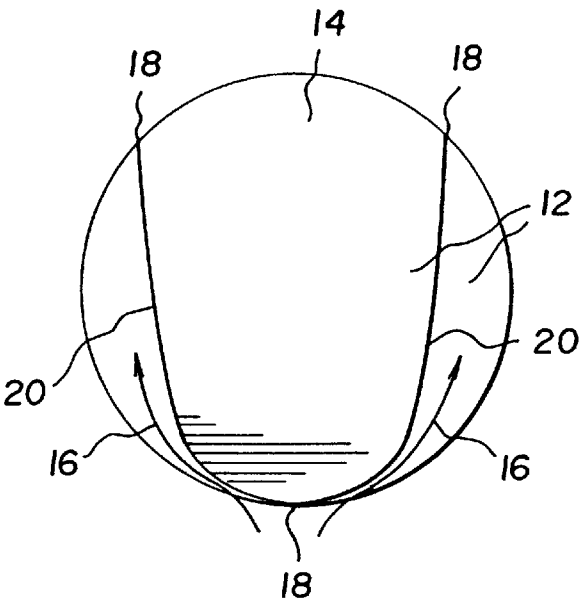
Figure 4A:
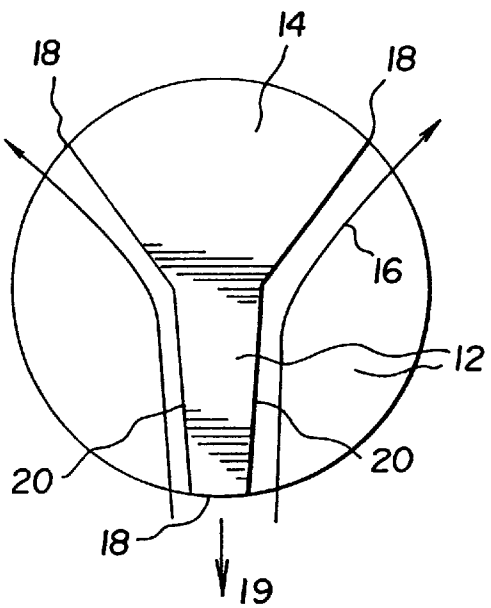

Alternate embodiments of the present invention are shown in FIGS. 4 and 5. As shown in FIG. 4, these embodiments each comprise a raised surface 14 in the abrasive layer of PDC cutter 10 where debris 16, such as chips from the material being cut, is deflected to the sides of the cutter and away from cutting edge 18. However, in these embodiments, PDC cutter 10 has a varying number of cutting edges in one cutter, thus varying the life of the cutter. For example, the Y-shaped cutter has either 3 or 4 cutting edges, the U-shaped cutter has 2 or 3 cutting edges, and the V-shaped cutter has 3 cutting edges. Obviously, in this context the front of cutter 10 corresponds to the cutting edge 18 selected for use at any given time.

Similar to the embodiment in FIG. 1, raised surface 14 is part of the PCD layer 12 and acts as a wedge to force material to the sides and out of the direct path of cutting edge 18. Additionally, raised surface 14 may fail (i.e., crack, breakout, chip, etc.) without significantly affecting the performance of cutter 10. Also, cutting edge 18 may also comprise a sloped entry to raised surface 14 for increased cutting action.

Furthermore, it is important to note that for all embodiments of the present invention PCD layer 12 is formed into its desired shape during the HT/HP process.

The present invention is valuable as it provides PDC cutters with unique properties. The PCD surface geometry of the present invention provides for the redirection of the chips and debris away from the cutting region. The primary advantage of this surface geometry is enhanced performance and less breakage due to a cutting area free of chip and debris.

While the present invention has been described with reference to one or more preferred embodiments, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention.

What is claimed is:

1. An abrasive tool insert consisting essentially of:

a polycrystalline diamond layer having front, rear, top and bottom surfaces; and a tungsten carbide substrate;

wherein said bottom surface of said polycrystalline diamond layer is bonded to said tungsten carbide substrate, wherein said front surface is narrower than said rear surface, wherein said top surface is narrower than said bottom surface, and wherein said front, rear, top and bottom surfaces of said polycrystalline diamond layer create a raised region having at least one cutting edge and at least one deflecting edge which channels debris away from the cutting edge of said polycrystalline diamond layer.

2. A tool insert according to claim 1, wherein said polycrystalline diamond layer is selected from the group consisting of diamond and cubic boron nitride.

3. A tool insert according to claim 1, wherein said raised region of said polycrystalline diamond layer is U-shaped.

4. A tool insert according to claim 1, wherein said raised region of said polycrystalline diamond layer is V-shaped.

5. A tool insert according to claim 1, wherein said raised region of said polycrystalline diamond layer is Y-shaped.

6. An improved abrasive tool insert comprising:

an abrasive layer; and a cemented carbide substrate bonded to said abrasive layer;

wherein said abrasive layer contains a raised region with at least one cutting edge, said raised region shaped such that a deflecting edge is created, and wherein said deflecting edge channels debris away from the cutting edge of said abrasive layer, and further wherein said abrasive layer has an upper exposed surface and a lower surface bonded to said cemented carbide substrate, and wherein said upper surface is narrower than said lower surface.

7. A tool insert comprising:

an abrasive layer having upper and lower surfaces, said upper surface being narrower than said lower surface, said upper surface further comprising a raised region with one or more cutting edges and a deflecting edge for channeling debris away from said cutting edge; and a cemented carbide substrate bonded to said lower surface of said abrasive layer.

8. A tool insert comprising:

an abrasive layer comprising a raised region with one or more cutting edges, said raised region increasing in width as one moves radially inward on said tool insert from said cutting edge, said raised region being U-shaped such that one or more deflecting edges are created;

and a cemented carbide substrate bonded to said abrasive layer.

9. A tool insert comprising:

an abrasive layer comprising a raised region with one or more cutting edges, said raised region increasing in width as one moves radially inward on said tool insert from said cutting edge, said raised region being Y-shaped such that one or more deflecting edges are created; and a cemented carbide substrate bonded to said abrasive layer.

* * * * *